US006152210A

United States Patent [19]

Baharis et al.

[11] Patent Number: 6,152,210

[45] Date of Patent: Nov. 28, 2000

[54] METAL CASTING

[75] Inventors: Chris Baharis, Wantirna; James Arthur O'Neill, Figtree; Roderick William Charles Vance, Elwood, all of Australia

[73] Assignees: Ishikawajima-Harima Heavy Industries Company Limited, Tokyo, Japan; BHP Steel (JLA) Pty Ltd, Melbourne, Australia

[21] Appl. No.: 08/833,432

[22] Filed: Apr. 7, 1997

Related U.S. Application Data

[63] Continuation-in-part of application No. 08/541,718, Oct. 10, 1995, abandoned.

[30] Foreign Application Priority Data

Oct. 14, 1994 [AU] Australia ..... PM8838

[51] Int. Cl.[7] ..... B22D 11/06; B22D 27/02

[52] U.S. Cl. ..... 164/502; 164/428

[58] Field of Search ..... 164/480, 428, 164/503, 467, 502, 466, 147.1

[56] References Cited

U.S. PATENT DOCUMENTS

| | | | |
|---|---|---|---|
| 5,191,928 | 3/1993 | Sato et al. | 164/466 |
| 5,197,534 | 3/1993 | Gerber et al. | 164/467 |
| 5,439,046 | 8/1995 | Miyazuwa et al. | 164/480 |

FOREIGN PATENT DOCUMENTS

| | | | |
|---|---|---|---|
| 1764784 | 9/1992 | U.S.S.R. | 164/503 |

*Primary Examiner*—Kuang Y. Lin

*Attorney, Agent, or Firm*—Arent Fox Kintner Plotkin & Kahn, PLLC

[57] ABSTRACT

Twin roll caster for casting metal strip comprises casting rolls (11) between which is formed a casting pool (16) of molten metal. The casting pool is confined at each end of the roll nip by end closure plate (22). Alternating electric current is supplied to electrical conductors (33) disposed outside the closure plate (22) so as to generate an electromagnetic field which extends through the closure plate and pushes back molten metal at the conjunctions (27) between the closure plate (22) and the rolls (11).

15 Claims, 3 Drawing Sheets

METAL CASTING

This application is a Continuation-in-Part Application under 35 U.S.C. 120 of prior commonly-assigned U.S. application Ser. No. 08/541,718, filed Oct. 10, 1995, now abandoned.

TECHNICAL FIELD

This invention relates to the casting of metal strip by the technique of twin roll casting. It has particular but not exclusive application to the casting of ferrous metal strip.

In a twin roll caster molten metal is introduced between a pair of contra-rotated chilled casting rolls so as to form a casting pool of molten metal above the nip between the rolls. Metal shells solidify on the moving roll surfaces and are brought together at the nip between them to produce a solidified strip product at the outlet from the roll nip. The term "nip" is used herein to refer to the general region at which the rolls are closest together. The molten metal may be introduced into the nip between the rolls via a tundish and a metal delivery nozzle located beneath the tundish so as to receive a flow of metal from the tundish and to direct it into the nip between the rolls.

It is necessary in a twin roll caster to confine the molten metal in the casting pool at the two ends of the nip between the casting rolls. Conventionally this is done by means of a pair of stationary refractory end closures which are held against the rotating rollers with sliding engagement at two ends of the nip so as to confine or dam the molten metal against escape from the casting pool. In operation, the refractory end closures suffer from wear because of their sliding engagement with the rotating casting rolls and they must be replaced frequently, often after a single cast. This is particularly so when gouging occurs along the refractory end closures where they meet the roll edges. Such gouging can be caused by at least two phenomena. Firstly, the changing positions of the roll edges due to thermal expansion can lead to significant gouging. Secondly, movements of the rolls relative to one another can lead to discrete particles of frozen metal becoming trapped at the roll edges and acting as abrasive particles against the end closures.

In an endeavour to overcome the end closure wear problem, it has been proposed in the casting of ferrous metal strip to employ electromagnetic confinement of the casting pool. Examples of such proposals are described in the specification of U.S. Pat. No. 4,936,374 assigned to the United States Department of Energy, U.S. Pat. Nos. 5,197,534, 5,251,685 and 5,279,350 all assigned to Inland Steel Company, German Patent Application DE 4307850 of Thyssen Stahl AG and Usinor Sacilor, and International Patent Application No PCT/JP92/01668 of Nippon Steel Corporation. The proposals described in the first five of these specifications involve the use of intense alternating currents to generate magnetic fields at the ends of the casting pool to generate repulsive forces in the molten metal. The general approach has been to confine the ends of the casting pool solely by the action of such repulsive forces. However, this requires very accurate control of intense magnetic fields required to generate the total confining pressure for the pool leading to severe control problems. Moreover the electromagnetic field generating equipment is in danger of exposure to the molten metal, particularly at start-up. German Application DE 4307850 suggests the use of refractory material to assist in the confinement of the pool, but substantial parts of the pool around the edges of the rolls are confined purely by magnetic fields generated by conductors which are disposed at those locations and are potentially exposed directly to the molten metal. Again, there are severe control problems particularly on start-up and the magnetic field conductors are vulnerable to damage, particularly during start-up or in the event of a failure or fluctuation in the power supply.

International Application No PCT/JP92/01668 describes a proposal in which refractory end closures are set back slightly from the ends of the casting rolls so as to avoid sliding engagement and confining forces are generated in the molten metal by passing direct current through the molten metal at the ends of the casting pool to react with magnetic poles disposed adjacent the side dams. This proposal also presents very severe control problems since it is necessary to accurately control the intensity and direction of direct currents in the moving metal in the casting pool. Further, there is a difficulty in finding a suitable electrode material which can withstand attack from molten metal and carry the required current density.

The present invention provides an alternative technique which employs the combination of physical end closures and induction fields in a manner which can be more readily controlled than the previously proposed techniques and in which the field generators are not exposed at any time directly to the molten metal of the casting pool and are therefore not liable to damage in the event of a control or power failure or fluctuation.

Specifically, the present invention employs electrical conductors disposed outside refractory side closure plates to generate appropriate electromagnetic fields to push back molten metal at the conjunctions between the end closures and the casting rolls inwardly of the pool.

U.S. Pat. No. 5,191,928 of Sato et al discloses use of a high frequency magnetic field to impose a magnetic pressure to molten metal in a casting pool. FIGS. 2(A) and 2(B) thereof disclose an apparatus for applying a magnetic field to the casting pool in a twin roll strip caster. That apparatus makes use of a magnetic field convergence plate 3 which is spaced from but connected to a coil 4 so as to direct the magnetic field along the casting surfaces of the rolls, the magnetic field convergence plate being connected to a large cooling box 12. The shaping of the magnetic field by the plate 3 in this apparatus is designed to push the molten metal longitudinally along the casting rolls whereas the apparatus of the present invention is intended to produce forces directed more laterally inwardly of the casting surfaces. Moreover, the apparatus of the present invention provides a much more concentrated or focused magnetic field in the vicinity of the conjunctions between the confinement plates and the rolls from the upper regions of the pool right down to the lower region of the pool in the vicinity of the nip. It is most important to generate high push back forces in the vicinity of the nip because the ferrostatic pressure is highest in this region and leakage is most likely to occur at this location. The arrangement disclosed in Sato et al cannot concentrate the field as effectively as the apparatus of the present invention and in particular it cannot effectively direct an electromagnetic field into the lower regions of the pool in the vicinity of the nip because the concentrator must be spaced a long way below the conductor coil at this location. The apparatus of the present invention has been designed specifically to provide effective confinement at the nip region.

DISCLOSURE OF THE INVENTION

According to the invention there is provided strip casting apparatus for casting metal strip comprising a pair of casting rolls forming a nip between them, molten metal delivery means to deliver molten metal into the nip between the casting rolls to form a casting pool of molten metal above the nip between the rolls, pool confinement means to confine the casting pool of molten metal at each end of the nip, and roll drive means to rotate the rolls in mutually opposite directions so as to produce a solidified strip at the exit from the nip, wherein the pool confinement means comprises:

a pair of refractory end closure plates disposed one at each end of the nip to contact the molten metal of the pool substantially completely across both ends of the pool and dam it against outflow from the pool;

a pair of downwardly converging arcuate hollow tubular conductors disposed outside each end closure plate adjacent the curved conjunctions between the end closure plate and the casting rolls and curved so as to follow those conjunctions downwardly from the vicinity of the upper region of the casting pool to the vicinity of the lower region of the pool at the nip;

power supply means to supply alternating current to said conductors;

electrical connectors providing input and return connections for the power supply means to the upper and lower ends of said conductors whereby current will flow simultaneously through the arcuate conductors in the same direction between their upper and lower ends;

field concentrators of ferromagnetic material disposed about the arcuate conductors so as to substantially envelop the conductors between concentrator pole end faces closely facing the end closure plates so that substantially all of the electromagnetic field leaving the concentrators is directed from the pole end faces transversely into the end closure plates adjacent the conjunction between those plates and the casting rolls so as to concentrate the electromagnetic fields along said conjunctions from the upper region of the pool to the lower region of the pool in the vicinity of the nip whereby to push back molten metal inwardly of the pool along those conjunctions to prevent escape of molten metal between the end closure plates and the rolls.

The field concentrators may comprise portions of generally U-shaped cross section disposed about the arcuate conductors with the ends of the U-shapes directed toward said end closure plates.

Some of said portions may each be disposed about one of the conductors but at least one of said portions may be disposed about bottom segments of both conductors in the vicinity of the nip between the casting rolls.

Preferably, the pair of downwardly converging arcuate conductors disposed outside each end closure plate is part of a single electrical conductor structure disposed outside that plate, the said pair of conductors meeting at a bottom junction at their lower ends, the conductor structure further comprises an upper conductor interconnecting the upper ends of the downwardly convergent arcuate conductors and wherein said electrical connectors provide input and return connections to the upper conductor and the bottom junction respectively.

The electrical conductors may be arranged so that their upper parts are spaced further from the adjacent end closure plate and casting roll conjunctions than are their bottom parts whereby to decrease the pool confining forces toward the upper parts of the pool.

The invention also extends to a method of casting a strip of magnetic metal comprising introducing molten metal between a pair of casting rolls forming a nip between them so as to form a casting pool of molten metal above the nip, confining the casting pool at each end of the nip, and rotating the casting rolls in mutually opposite directions to produce a solidified metal strip passing from the nip, wherein the casting pool of molten metal is confined at the ends of the nip by providing a pair of end closures disposed one at each end of the nip to contact the molten metal of the pool substantially completely across both ends of the pool and dam it against outflow from the ends of the nip and applying alternating current to electrical conductors disposed outside the end closures so as to generate electromagnetic fields which extend through the end closures and push back molten metal at the conjunctions between the end closures and the casting rolls to prevent escape of molten metal between the end closures and the rolls.

BRIEF DESCRIPTION OF THE DRAWINGS

In order that the invention may be more fully explained, some particular embodiments will be described with reference to the accompanying drawings in which.

DETAILED DESCRIPTION OF THE PREFERRED EMBODIMENT

Figure 1:
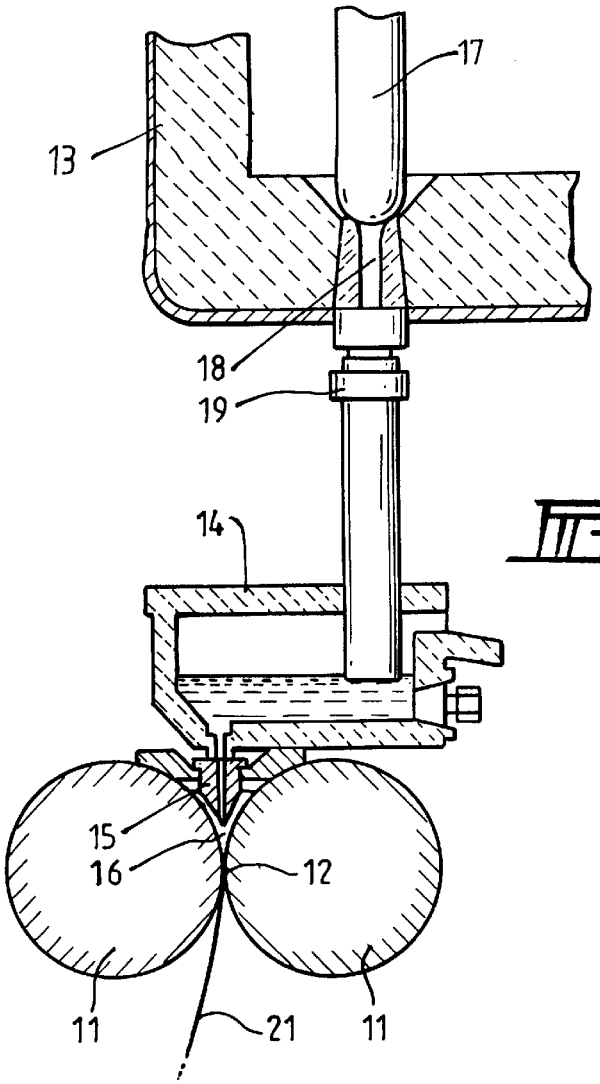
FIG. 1 is a vertical cross-section through a strip caster constructed in accordance with the invention.
Figure 4:
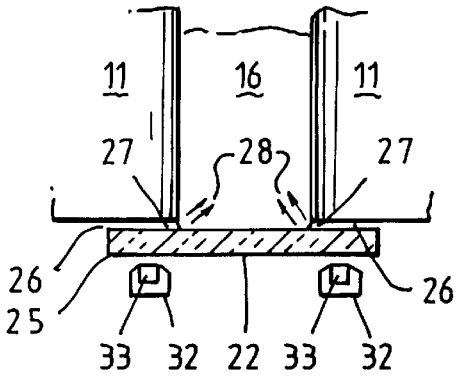
FIG. 4 is a horizontal cross-section generally on the line 4—4 in FIG. 3.

The strip caster illustrated in FIG. 1 comprises a pair of twin casting rolls 11 forming a nip 12 between them. Molten metal is supplied during a casting operation from a ladle 13 via a tundish 14 and a delivery nozzle 15 into the nip between rolls 11 so as to produce a casting pool 16 of molten metal above the nip. Ladle 13 is fitted with a stopper rod 17 actuable to allow the molten metal to flow from the ladle through an outlet nozzle 18 and a refractory shroud 19 into tundish 14.

Casting rolls 11 are provided with internal water cooling passages supplied with cooling water through the roller ends and they are contra-rotated by drive means (not shown) to produce a continuous strip product 21 which is delivered downwardly from the nip between the casting rolls. The casting roll surfaces are preferably coated, for example, by coating with a material which is ferromagnetic at the operating temperatures of these surfaces.

As thus far described the illustrated apparatus is as more fully described in granted U.S. Pat. Nos. 5,184,668 and 5,277,243 and Australian Patents 631728 and 637548. Reference may be made to these patents for full constructional and operational details of the apparatus. However, in accordance with the present invention the casting pool 16 is confined at the two ends of the nip by the combination of a pair of refractory end dam closure plates 22 and a pair of electromagnetic field generators denoted generally as 20. Each end dam closure plate 22 is shaped so as to have a wide top 23 and a narrow bottom 24 connected by arcuate sides 25 which overlap the ends of the casting rolls 11, the curvature of the sides 25 being matched with the curvature of the rolls. End dam closure plates 22 do not engage the ends of the casting rolls but are set back slightly from the ends of those rolls to leave small clearance gaps 26 between the sides 25 of the closure plates and the ends of the rolls.

The metal of casting pool 16 engages the closure plates 22 so that the closure plates serve to dam the metal. The electromagnetic field generators 20 serve to provide concentrated electromagnetic fields at the conjunctions 27 between the closure plates 22 and the end rollers which induce forces producing a confining pressure on the molten metal in these regions indicated by the arrows 28 to prevent the molten metal from escaping from the pool through the clearance gaps 26. With this arrangement most of the ferrostatic pressure at the ends of the pool is borne by the end closure plates 22 and the electromagnetically induced confining forces are only required to resist this pressure over the very small clearance gaps 26. Such confining pressures can be readily generated and controlled by appropriate electromagnetic field generators as will now be described.

Each of the electromagnetic field generators 20 comprises a specially shaped electrical conductor structure 31 fitted with field shaping core pieces 32. The conductor structure 31 is formed of heavy copper tubing of square cross-section which serves both as an electrical conductor and as a conduit for the flow of cooling water or other cooling fluid, such as SYLTHERM 800 (Trade Mark) by Dow Corning, through the conductor structure to extract heat generated by the large current flows required to generate the necessary electromagnetic fields. Typically a 10 kHz alternating current of 15,000 amps and 500 volts will be required.

Each conductor structure 31 comprises a pair of arcuate tubular conductors 33 which are disposed immediately outside the closure plates 22 adjacent the lines of conjunction 27 between the closures plates and the rolls. Conductors 33 converge downwardly and are curved to follow the curvature of the rolls and therefore the lines of conjunction between the rolls and the closure plates. They are joined together at the bottom 34 of structure 31 and their upper ends are interconnected by a curved upper conductor 35. A pair of current supply connectors 36, 37 lead respectively to the mid-point of top conductor 35 and to the junction 34 between the bottom ends of the side conductors 33.

Figure 6:
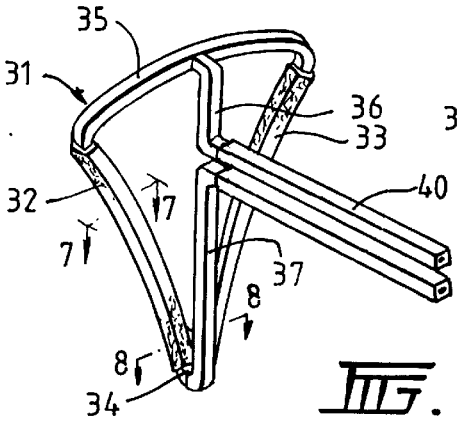
FIG. 6 illustrates part of a field generating conductor structure forming part of the pool confining means.

Connectors 36, 37 can be connected to a supply of alternating electric current through appropriate supply leads such as the leads 40 indicated in outline in FIG. 6 and these may also be hollow to allow the circulation of cooling fluid to and from the conductor structure. The electrical supply may incorporate a heat station comprising capacitors and/or transformers (not shown).

The alternating electric current flows via connectors 36, 37 through the side conductors 33 which are spaced close to and extend along the lines of conjunction between the side plates 22 and the ends of the casting rolls 11. The side conductors 33 and top conductor 35 of each conductor structure 31 form a planar configuration disposed in one plane and the supply connectors 36, 37 are disposed for the most part in a second plane which is very close to the first plane. It has been found that this is very important to minimise the inductance of the conductor structure as a whole.

Figure 7:
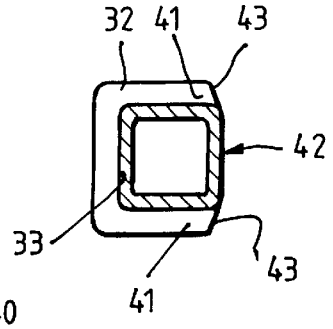
FIG. 7 is a cross-section generally on the line 7—7 in FIG. 6.
Figure 8:
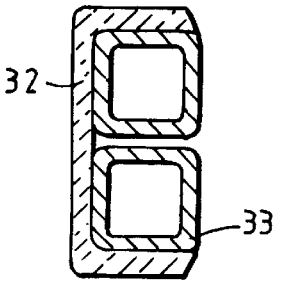
FIG. 8 is a cross-section generally on the line 8—8 in FIG. 6.

The field concentration apparatus comprise pieces 32 ferromagnetic material which are of generally U-shaped cross-section so as to define pole ends 41 separated by gaps 42. The concentrator pieces are fitted to the arcuate conductors 33 so as to encompass those segments with their pole ends 41 facing inwardly toward the side closure plates 22 and therefore toward the regions of conjunction between the side plates and the end rolls. The pieces 32 may comprise a series of narrow U-shaped pieces spaced along the conductors or they may be formed as elongate channel shaped pieces. As shown in FIGS. 7 and 8, the concentrator pieces may each be disposed about only one of the conductors 33 throughout most of the conductor structure, but the bottom segments of the conductors 33 which join in the vicinity of the nip may be located within a single U-shaped section of the field concentrator.

Figure 5:
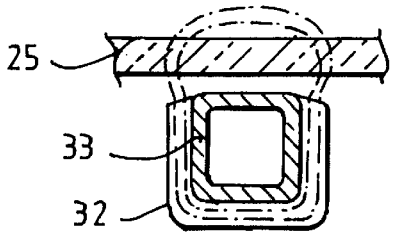
FIG. 5 is an enlargement of some of the components shown in FIG. 4.
Figure 3:
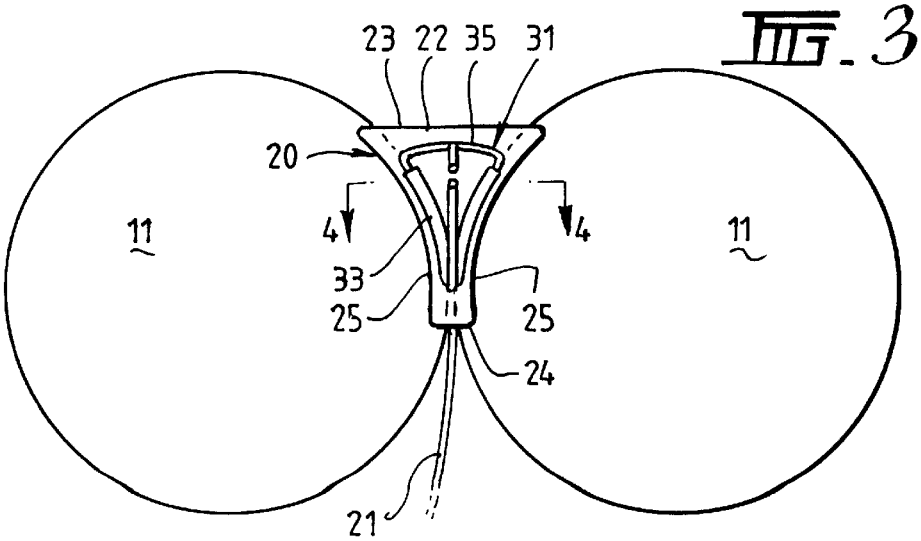
FIG. 3 is an end view of the components illustrated in FIG. 2.
Figure 2:
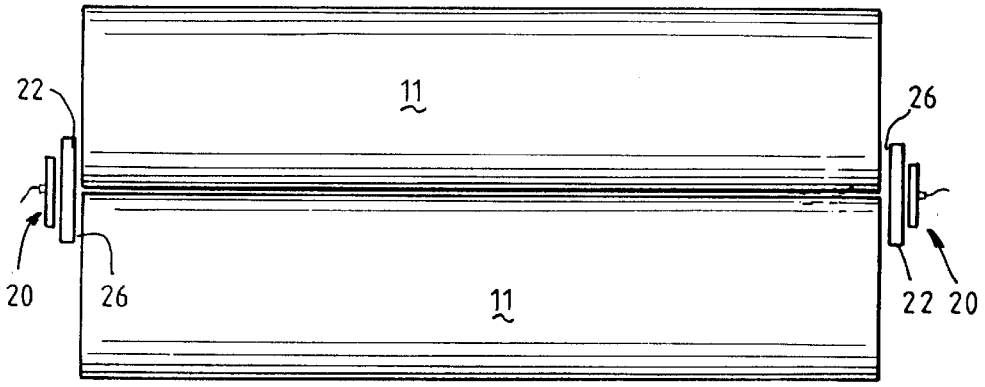
FIG. 2 is a plan view of the casting rolls and pool confinement means of the caster illustrated in FIG. 1.

The location and shaping of the conductor 33 and field concentrations 32 is such as to concentrate the resulting magnetic fields in the regions of conjunction between the end closure plates and the casting rolls. As most clearly seen in FIG. 5, there is the smallest possible gap between the pole ends of the concentrator within which the field can extend out of the concentrator and the field in this gap is directed by the pole ends transversely into the end closure plates adjacent the conjunctions between those plates and the casting rolls. In this way the electromagnetic fields are very effectively concentrated along said conjunctions from the upper region of the pool to the lower region of the pool in the vicinity of the nip.

The resulting magnetic fields emanating from the concentrators will thus be concentrated in the regions of conjunction between the end closure plates and the casting rolls. The outer faces 43 of the pole ends 41 may slope outwardly and backwardly from the gap 42 so as to shape the field in such a way that it is flattened and widened thereby to ensure that at the regions of conjunction between the side plates 22 and the rolls the field flux extends in directions generally parallel with the side plates and therefore along the gaps 26 to produce maximum push back from the gaps. The outer faces 43 of the pole ends may slope back at angles up to 30° from the plane defined by the outer end of the core gap 42.

To cause reorientation of the flux lines near the conjunction of the rolls and side plates such that they are normal to the roll face, a coating of around 100 microns of ferromagnetic material such as nickel or a nickel alloy is applied to the roll surface.

Figure 10:
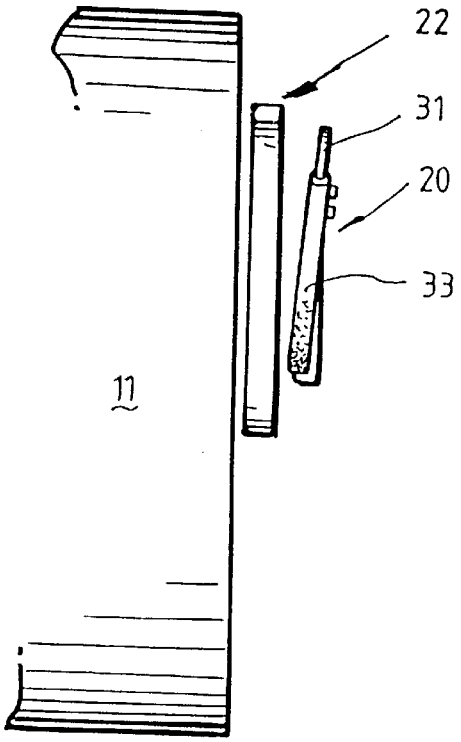
FIG. 10 illustrates how the field generating conductor may be tilted to improve shaping of the magnetic field.
Figure 11:
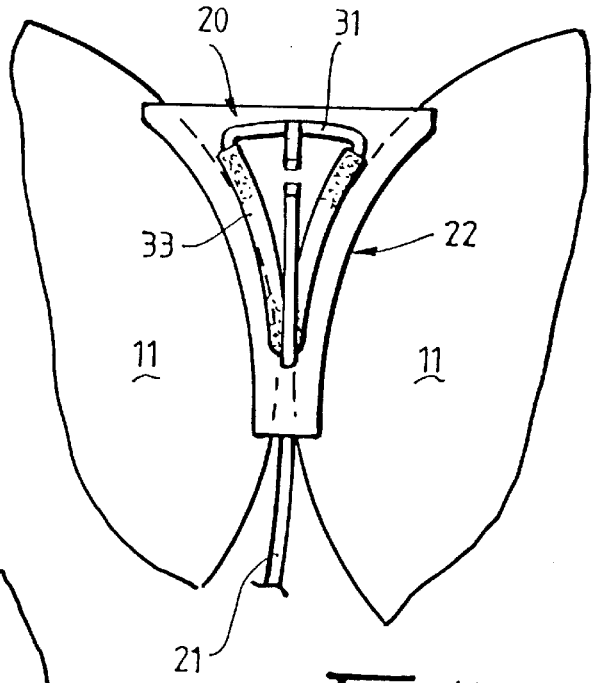
FIG. 11 illustrates how shaping of the field may be improved by varying the shape of the field generating conductor.
Figure 12:
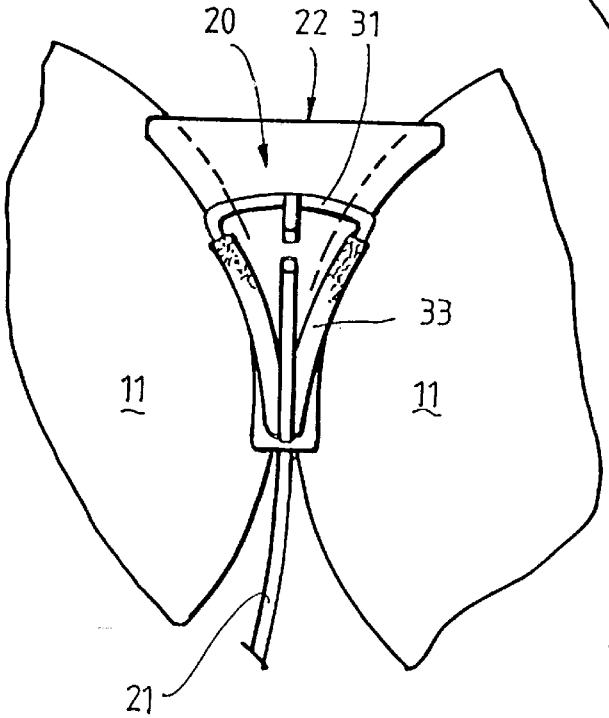
FIG. 12 illustrates how appropriate field shaping may be achieved by a change in the field horizontal alignment of the field generating conductor.

To further improve the shaping of the magnetic field and control the confining forces on the pool, the upper ends of the conductor structures 31 may be tilted outwardly and backwardly from the side closure plates 22 as illustrated in FIG. 10. This enables the confining forces generated on the metal in the pool to be matched with the ferrostatic pressure which increases downwardly toward the nip so that more confining pressure is required toward the nip than in the upper regions of the pool. It also prevents excessive push back of the molten metal on the upper parts of the rollers which can lead to impaired solidification at the edges of the strip. A similar effect may be achieved by varying the shape of the side segments 33 of the conductor structures 31 so that they do not precisely follow the roll shape but have a configuration such that they are closest to the lines of conjunction between the rolls and the side closure plates at the nip and gradually become further away toward their upper ends as illustrated in FIG. 11. In another alternative, the conductor structures may be moved slightly downwards so that the side segments 33 are displaced downwardly from positions in which they would be in best horizontal alignment with the lines of conjunction between the rolls and the side closure plates as illustrated in FIG. 12. Because the lines of conjunction and corresponding parts of the conductor segments become more upright toward the roller nip, there will be progressively lesser misalignment toward the nip.

To further shape the electric field at the roll edges so as to maximise push back forces on the molten metal, the gaps between the side dam closures and the rolls may be filled by generally non-conducting spacers.

A typical twin roll caster producing 1 meter wide steel strip at the rate of 60 meters per minute will require the following operational parameters for adequate electromagnetic pool confinement:

Magnetic flux density—0.2 Tesla
Current density—15,000 amps per end conductor
System inductance—0.5 microhenry per end conductor
Power input to melt—100 kilowatts per end
Power input to rolls—2 kilowatts per end
Reactive power requirements—15 MVA for the whole system
Real power—approximately 400 kilowatts Operation under the above parameters will require extraction of approximately 100 kilowatts of Ohmic losses from the system as a whole ie 25 kilowatts from each of the four conductor segments 33. This can be achieved by pumping cold water through the hollow copper conductor tubing at high pressure.

Figure 9:
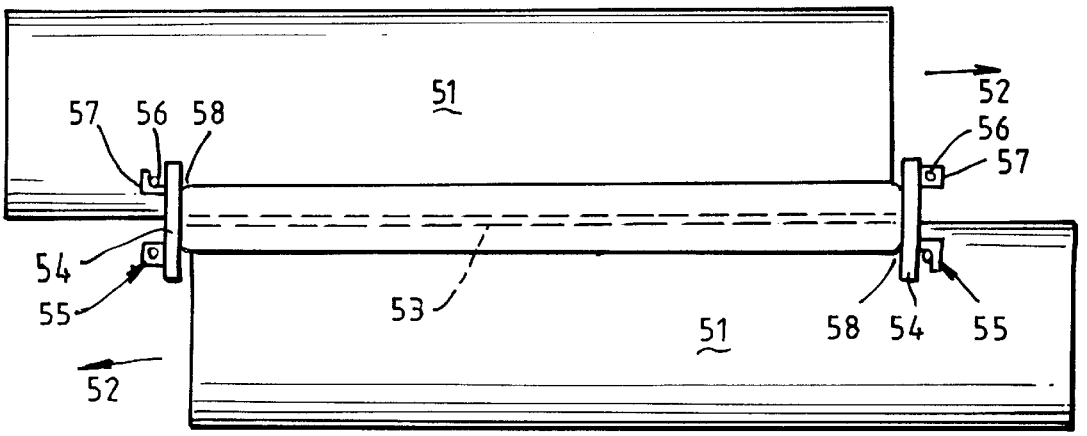
FIG. 9 diagrammatically illustrates a modified strip caster constructed in accordance with the invention.

FIG. 9 illustrates a modified twin roll caster constructed in accordance with the invention in which the casting rolls 51 are moveable longitudinally relative to one another as indicated by the arrows 52 in order to adjust the length of the nip 53 between them so as to enable strips of varying width to be produced by adjustment of the one piece of apparatus and without changing the rolls. In this case the casting pool is confined by a pair of side closure plates 54 and a pair of electromagnetic field generators 55 comprising conductors 56 and pole pieces 57.

Since the rolls 51 overlap one another in the longitudinal direction the side closure plates 54 cannot overlap the ends of both rollers. In each case one side of the side closure plate overlaps an end of one of the rollers 51 but its other side is shaped so as to extend around the circumference of the adjacent roller 51 leaving a small clearance space 58 between the side plate and the roller. The electromagnetic field generators 55 may be generally similar to the field generators of the apparatus illustrated in FIGS. 1 to 8, but the conductor segments adjacent the gaps 58 may be modified in shape so as to direct the magnetic flux in the best direction to maximise the effectiveness of the pool confinement forces in that region.

In both of the illustrated embodiments the end closure plates extend completely across the pool ends so as to provide most of the pool confining forces and to completely shield the electrical conductor structures from molten metal of the pool. The magnetic fields only need to create sufficient repulsive forces to prevent entry of metal into the very small gaps between the end closures and the roll ends. Such forces can be readily generated and finely controlled. Moreover, even in the event of a power fluctuation or failure, the pool will still be substantially confined by the refractory side closures and there is no danger of massive leakage or damage to field generating equipment.

The illustrated forms of apparatus have been advanced by way of example only and they could be modified considerably. As already indicated with reference to the embodiment illustrated in FIG. 7, the precise shaping of the conductor segments may need to be varied according to the precise application of the invention. Moreover, it is not necessary that the conductor segments following the shape of the two casting rolls be interconnected into a single conductor structure and it would be possible to provide two separate conductors. In that case, only one of the conductors need be taken downwardly as far as the nip since at that point the two solidifying shells have been brought together and very little liquid metal remains to jet out from the ends of the pool. Accordingly a single conductor will be sufficient to generate sufficient confining forces at this location and the other conductor may traverse only an upper part of the pool/casting roll interface. This will also avoid the complexities involved in fitting magnetic core pieces around two closely spaced conductors. It is accordingly to be understood that the invention is in no way limited by the constructional details of the illustrated apparatus and that many modifications and variations will fall within the scope of the appended claims.

In a different aspect, the present invention relates to strip casting apparatus for casting a strip of magnetic metal comprising a pair of casting rolls forming a nip between them, molten metal delivery means to deliver molten metal into the nip between the casting rolls to form a casting pool of molten metal above the nip between the rolls, pool confinement means to confine the casting pool of molten metal at each end of the nip, and roll drive means to rotate the rolls in mutually opposite directions so as to produce a solidified strip at the exit from the nip, wherein the pool confinement means comprises a pair of refractory end closures disposed one at each end of the nip to contact the molten metal of the pool substantially completely across both ends of the pool and dam it against outflow from the pool, a pair of electrical conductor means disposed one outside each of the end closures so as to be shielded from the molten metal of the casting pool by the end closures, and power supply means to supply alternating current to said conductor means whereby to generate electromagnetic fields which extend through the end closures and push back molten metal at the conjunctions between the end closures and the casting rolls inwardly of the pool to prevent escape of molten metal between the end closures and the rolls, and wherein each of the electrical conductor means comprises a pair of electrical conductors disposed outside the respective end closure adjacent the conjunctions between the end closure and the casting rolls and are shaped to follow those conjunctions whereby to concentrate their electromagnetic fields at those conjunctions, and the electrical conductors are arranged so that their upper parts are spaced further from the adjacent end closure and casting roll conjunctions than are their bottom parts whereby to decrease the pool confining forces toward the upper parts of the pool.

Each of the electrical conductor means may be a single electrical conductor structure comprising a pair of downwardly converging arcuate segments constituting said conductors.

The conductors may be tilted outwardly from the adjacent end closures.

Alternatively, or in addition, the conductors may be displaced downwardly from positions in which they would be in best horizontal alignment with the conjunctions between the end closures and the casting rolls.

Alternatively, or in addition, the conductors may depart from strict compliance with the curvature of the rolls so that they do not precisely follow the roll shapes but are configured such that they are closest to the lines of conjunction between the rolls and the adjacent end closure toward the nip and gradually become further away toward their upper parts.

In another aspect, the invention provides strip casting apparatus for casting a strip of magnetic metal comprising a pair of casting rolls forming a nip between them, molten metal delivery means to deliver molten metal into the nip between the casting rolls to form a casting pool of molten metal above the nip between the rolls, pool confinement means to confine the casting pool of molten metal at each end of the nip, and roll drive means to rotate the rolls in mutually opposite directions so as to produce a solidified strip at the exit from the nip, wherein the pool confinement means comprises a pair of refractory end closures disposed one at each end of the nip to contact the molten metal of the pool substantially completely across both ends of the pool and dam it against outflow from the pool, a pair of electrical conductor means disposed one outside each of the end closures so as to be shielded from the molten metal of the casting pool by the end closures, and power supply means to supply alternating current to said conductor means whereby to generate electromagnetic fields which extend through the end closures and push back molten metal at the conjunctions between the end closures and the casting rolls inwardly of the pool to prevent escape of molten metal between the end closures and the rolls, and wherein each of the electrical conductor means comprises a pair of electrical conductors disposed outside the respective end closure adjacent the conjunctions between the end closure and the casting rolls and are shaped to follow those conjunctions whereby to concentrate their electromagnetic fields at those conjunctions, the conductors comprise hollow electrically conductive metal tubes and there is cooling means to circulate cooling fluid through the tubes.

Each of the electrical conductors may be disposed within a series of ferromagnetic core pieces defining pole ends to shape the electromagnetic field induced by the electrical conductor.

The core pieces may be substantially U-shaped.

The side dam closures may be set so as to define small gaps between them and the casting rolls. Said gaps may be clearance gaps or they may be occupied by generally non-conducting spacers.

In a further aspect, the invention provides a method of casting a strip of magnetic metal comprising introducing molten metal between a pair of casting rolls forming a nip between them so as to form a casting pool of molten metal above the nip, confining the casting pool at each end of the nip, and rotating the casting rolls in mutually opposite directions to produce a solidified metal strip passing from the nip, wherein the casting pool of molten metal is confined at the ends of the nip by providing a pair of end closures disposed one at each end of the nip to contact the molten metal of the pool substantially completely across both ends of the pool and dam it against outflow from the ends of the nip and applying alternating current to electrical conductors disposed outside the end closures so as to generate electromagnetic fields which extend through the end closures and push back molten metal at the conjunctions between the end closures and the casting rolls to prevent escape of molten metal between the end closures and the rolls, the electromagnetic fields are generated in such a manner as to be concentrated at the conjunctions between the end closures and the casting rolls, and the electromagnetic fields are generated so as to induce pool confining forces which progressively decrease upwardly of the conjunctions between the end closures and the casting rolls.

We claim:

1. Strip casting apparatus for casting metal strip comprising a pair of casting rolls forming a nip between them, molten metal delivery means to deliver molten metal into the nip between the casting rolls to form a casting pool of molten metal above the nip between the rolls, pool confinement means to confine the casting pool of molten metal at each end of the nip, and roll drive means to rotate the rolls in mutually opposite directions so as to produce a solidified strip at the exit from the nip, wherein the pool confinement means comprises:

a pair of refractory end closure plates disposed one at each end of the nip to contact the molten metal of the pool substantially completely across both ends of the pool and dam it against outflow from the pool;

a pair of downwardly converging arcuate hollow tubular conductors disposed outside each end closure plate adjacent the curved conjunctions between the end closure plate and the casting rolls and curved so as to follow those conjunctions downwardly from the vicinity of the upper region of the casting pool to the vicinity of the lower region of the pool at the nip;

power supply means to supply alternating current to aid conductors;

electrical connectors providing input and return connections for the power supply means to the upper and lower ends of said conductors such that current will flow simultaneously through the arcuate conductors in the same direction between their upper and lower ends;

field concentrators of ferromagnetic material disposed about the arcuate conductors so as substantially to envelop the conductors between concentrator pole end faces closely facing the end closure plates so that substantially all of the electromagnetic field leaving the concentrators is directed from the pole end faces transversely into the end closure plates adjacent the conjunction between those plates and the casting rolls so as to concentrate the electromagnetic fields along said conjunctions from the upper region of the pool to the lower region of the pool in the vicinity of the nip such that to pushing back molten metal inwardly of the pool along those conjunctions to prevent escape of molten metal between the end closure plates and the rolls.

2. Strip casting apparatus as claimed in claim 1, wherein the field concentrators comprise portions of generally U-shaped cross section disposed about the arcuate conductors with the ends of the U-shapes directed toward said end closure plates.

3. Casting apparatus as claimed in claim 2, wherein some of said portions are each disposed about one of the conductors but at least one of said portions is disposed about bottom segments of both conductors in the vicinity of the nip between the casting rolls.

4. Casting apparatus as claimed in claim 1, wherein the pair of downwardly converging arcuate conductors disposed outside each end closure plate is part of a single electrical conductor structure disposed outside that plate, said pair of conductors meeting at a bottom junction at their lower ends, the conductor structure further comprising an upper conductor interconnecting the upper ends of the downwardly convergent arcuate conductors and said electrical connectors providing input and return connections to the upper conductor and the bottom junction, respectively.

5. Strip casting apparatus as claimed in claim 1, wherein the electrical conductors are arranged so that their upper parts are spaced further from the adjacent end closure plate and casting roll conjunctions than are their bottom parts thereby decreasing the pool confining forces toward the upper parts of the pool.

6. Strip casting apparatus as claimed in claim 4, wherein the conductors are tilted so as to incline upwardly and outwardly away from the adjacent end closure plate such that their upper parts are displaced further from the casting pool than are their bottom parts.

7. Strip casting apparatus as claimed in claim 4, wherein the conductors are displaced downwardly from the positions in which they would be in best horizontal alignment with the conjunctions between said end closure plates and the casting rolls.

8. Strip casting apparatus as claimed in claim 4, wherein the conductors depart from strict compliance with the curvature of the rolls so that they do not precisely follow the roll shapes but are configured such that they are closest to the lines of conjunction between the rolls and the adjacent end closures toward the nip and gradually become further away toward their upper parts.

9. Strip casting apparatus as claimed in claim 1, wherein the refractory end closure plates are set so as to define small gaps between them and the casting rolls.

10. Strip casting apparatus as claimed in claim 9, wherein said gaps are clearance gaps.

11. Strip casting apparatus as claimed in claim 1, wherein the casting surfaces of the rolls are coated with a ferromagnetic material.

12. Strip casting apparatus as claimed in claim 11, wherein the coating material contains nickel.

13. Strip casting apparatus as claimed in claim 4, wherein said downwardly converging arcuate conductor and said upper conductor are disposed in a first plane and said electrical connectors are disposed in a second plane proximate said first plane.

14. Strip casting apparatus as claimed in claim 2, wherein the ends of each U-shape defines a gap therebetween and each of said pole end faces slopes outwardly and backwardly from said gap.

15. Strip casting apparatus as claimed in claim 14, wherein said pole end faces slope back at angles up to 30° from the plane defined by said gap.

* * * * *